US006033050A

United States Patent [19]

Morita et al.

[11] Patent Number: 6,033,050

[45] Date of Patent: Mar. 7, 2000

[54] LIQUID EJECTION PRINTING APPARATUS WITH VARYING FREQUENCY PRELIMINARY EJECTION

[75] Inventors: Osamu Morita, Yokosuka; Masayoshi Tachihara, Chofu, both of Japan

[73] Assignee: Canon Kabushiki Kaisha, Tokyo, Japan

[21] Appl. No.: 08/426,197

[22] Filed: Apr. 21, 1995

[30] Foreign Application Priority Data

Apr. 26, 1994 [JP] Japan ..... 6-088878

[51] Int. Cl.[7] ..... B41J 2/165

[52] U.S. Cl. ..... 347/23; 347/27

[58] Field of Search ..... 347/5, 17, 23, 347/35, 27

[56] References Cited

U.S. PATENT DOCUMENTS

| | | | |
|---|---|---|---|
| 4,245,224 | 1/1981 | Isayama et al. | 347/35 X |
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,332 | 12/1985 | Takahashi | 347/23 X |
| 4,558,333 | 12/1985 | Sugitani et al. . | |
| 4,608,577 | 8/1986 | Hori . | |
| 4,609,925 | 9/1986 | Noru et al. | 347/27 |
| 4,692,777 | 9/1987 | Hasumi | 347/23 |
| 4,723,129 | 2/1988 | Endo et al. . | |
| 4,727,378 | 2/1988 | Le et al. | 347/35 |
| 4,740,796 | 4/1988 | Endo et al. . | |
| 4,926,196 | 5/1990 | Mizoguchi et al. | 347/23 |
| 5,339,098 | 8/1994 | Nagatomo et al. | 347/5 |
| 5,673,071 | 9/1997 | Fuse | 347/35 |

FOREIGN PATENT DOCUMENTS

| | | |
|---|---|---|
| 0442438 | 8/1991 | European Pat. Off. . |
| 442438 | 8/1991 | European Pat. Off. . |
| 0499432 | 8/1992 | European Pat. Off. . |
| 0559122 | 9/1993 | European Pat. Off. . |
| 54-056847 | 5/1979 | Japan . |
| 57-002765 | 1/1982 | Japan . |
| 59-123670 | 7/1984 | Japan . |
| 59-138461 | 8/1984 | Japan . |
| 60-071260 | 4/1985 | Japan . |
| 61-146548 | 7/1986 | Japan . |
| 62-116153 | 5/1987 | Japan . |
| 63-260450 | 10/1988 | Japan . |
| 2202453 | 8/1990 | Japan . |

*Primary Examiner*—John Barlow
*Assistant Examiner*—C. Dickens
*Attorney, Agent, or Firm*—Fitzpatrick, Cella, Harper & Scinto

[57] ABSTRACT

A liquid ejection printing apparatus quickly perform preliminary ejection with certainty. The liquid ejection printing apparatus ejects droplets of a liquid printing material through a printing head to a medium to be printed for depositing the printing material to perform printing. The liquid ejection printing apparatus performs preliminary ejection upon the onset of power supply and/or prior to initiation of printing while varying a drive frequency of the printing head during the preliminary ejection.

27 Claims, 11 Drawing Sheets

LIQUID EJECTION PRINTING APPARATUS WITH VARYING FREQUENCY PRELIMINARY EJECTION

BACKGROUND OF THE INVENTION

1. Field of the Invention

The present invention relates generally to a liquid ejection printing apparatus which performs printing by ejecting liquid to form ejected liquid drops to deposit on a medium to be printed. More specifically, the invention relates to a liquid ejection printing apparatus having a preparatorily ejecting function and a printing method thereof. Here, the term printing includes providing ink on all types of ink support, such as cloths, yarns, paper, sheet members and so forth. The definition of printing apparatus covers a variety of information processing apparatuses or a printers as an output device therefor. The present invention is suitable for those applications.

2. Description of Related Art

In a liquid ejection printing apparatus performing printing by ejecting liquid, it has been known to cause ejection failure, in which a liquid droplet cannot be ejected despite the fact that a normal ejection signal is transmitted upon initiation of printing, when the printing apparatus has been left without performing printing for a long period.

As a major cause of occurrence of initial ejection failure, the following two causes are considered.

The first cause is lowering of the temperature of liquid under low temperature environment. Associated with this, viscosity of the liquid may be increased. Due to viscous resistance of the liquid, required energy for liquid ejection can be increased to cause ejection failure due to lack of ejection energy.

A second cause is increasing of viscous resistance due to increasing of viscosity of the liquid resulting from evaporation of the liquid at ejection openings. This is significant in a low temperature and low humidity environment and will cause a serious problem in the liquid ejection printing system.

As one of the measures to resolve this, there is a method using a preliminary ejection system. This system automatically performs ejection of liquid toward a liquid absorbing body and so forth a reasonable number of times upon onset of a power supply or when printing has not been performed for a long period, for ejecting out liquid having high viscosity and thus for lowering the viscosity of the liquid. During this preliminary ejection, liquid ejection failure can be resolved to obtain normal ejection upon printing.

Also, pre-heating in advance of ejection has also been performed. For instance, Japanese Patent Application Laid-Open No. 2765/1982 discloses a printing apparatus which can lower viscosity of ink by heating high viscous ink within an ejection head immediately before initiation of printing.

Also, Japanese Patent Application Laid-Open No. 146548/1986 (U.S. Pat. No. 5,339,098) discloses a method, in which a dedicated controller for controlling ejection from a head unit is provided and a pre-heating process and a preliminary ejection process are performed employing such dedicated controller.

Furthermore, Japanese Patent Application Laid-Open No. 116153/1987 discloses means for making a printing heat to perform non-printing ejection of a liquid printing material at a position outside of a printing region depending upon environmental conditions of a place where the apparatus is located.

Conventionally, an ejection drive frequency for preliminary ejection is set a fixed value which is lower than or equal to a frequency in actual printing and thus cannot be varied. This creates problems set out below.

For instance, in the case of an apparatus employing a thermal ink jet head, it may be possible that no liquid droplet is ejected with the first drive signal upon performing preliminary ejection. One of the causes may be a failure of generation of a bubble on a heater. In such case, for recovery to a printing operation, it becomes necessary to forcedly remove printing liquid having increased viscosity by way of a suctioning operation or so forth to introduce printing liquid in which bubbles can be generated from a supply system. It may be also possible that a liquid droplet cannot be formed, though a bubble is generated on the heater. In addition, even when a liquid droplet can be ejected at the first drive signal, it may be possible that the viscosity of printing liquid cannot be lowered unconditionally. Namely, when the second drive signal is applied before disappearance of the bubble generated by the first drive signal, behavior of the bubble becomes unstable to possibly reside as a fixed bubble, making subsequent preliminary ejection completely impossible. In general, high viscous ink takes a longer period for a bubble to disappear compared with low viscous ink. Therefore, the foregoing problem is likely to be caused at first and second ejection.

As shown in FIG. 10, with experimental head 03 in which heater 02 of 18 $\mu$m×24 $\mu$m is disposed in a straight tube form liquid passage 01 having a liquid passage length of 200 $\mu$m and a liquid passage cross section of 20 $\mu$m×20 $\mu$m , water/glycerine solution is supplied to a liquid chamber 04 through a supply tube 05. Then, a life of a bubble generated on heater 02 was measured. The result of measurement is shown in FIG. 11. As shown in FIG. 11, it was appreciated that the life of the bubble is abruptly expanded according to increasing of viscosity of the liquid.

Accordingly, when a printing liquid droplet is ejected by the first drive signal of preliminary ejection, the following problem may arise. As set forth above, the liquid having increased viscosity has increased viscous resistance. As set forth above, since the liquid having increased viscosity has increased viscous resistance, after first ejection at a drive frequency of normal printing in preliminary ejection, if the subsequent second, third and fourth drive signals are applied before the meniscus of the ejection opening is completely resumed, the meniscus becomes quite unstable so as not to successfully eject the liquid with the increased viscosity. In particular, under low temperature and low humidity environment, the viscosity of the liquid is further increased to further increase viscous resistance to make it difficult to successfully perform preliminary ejection.

It can be a solution for the problem set forth above to perform preliminary ejection with a constant frequency lower than the drive frequency in normal driving. With this method, after meniscus recovers after the first ejection, it may be possible to gradually lower viscous level in the liquid ejection printing apparatus toward normal viscosity by carrying out sequentially the second, third and fourth ejections of high viscous liquid. However, since the preliminary ejection is continued at a constant low frequency even when the viscosity of the liquid is lowered to be close to the normal viscosity of the normal liquid, it takes a long period of time in the preliminary ejection. This results in delay in entry into actual printing operation.

In particular, in a thermal ink-jet head for high density printing, since the liquid passage is fine, particularly after leaving non-printing, the life of the bubble becomes extraordinarily long, e.g. several tens msec to several hundreds msec. The drive frequency to successfully and normally perform the preliminary ejection with such head becomes approximately 1 Hz. In such head, if the preliminary ejection is performed at the constant frequency of approximately 1 Hz, it may inherently take several minutes.

Moreover, the drive frequency in the preliminary ejection tends to be significantly influenced by the environmental condition in use. The drive frequency of the print head in the preliminary ejection is normally set low in view of severe condition. Accordingly, such setting is effective under bad environmental condition, but under good environmental condition where ejection failure is unlikely to be caused, the preliminary ejection has to be performed at the excessively low constant frequency, resulting in prolonging the preliminary ejection period.

SUMMARY OF THE INVENTION

It is an object of the present invention to provide a liquid ejection printing apparatus and a printing method employing the printing apparatus, in which a preliminary ejection can be certainly and quickly performed.

In a first aspect of the present invention, there is provided a liquid ejection printing apparatus for ejecting a droplet of a liquid state printing material through a printing head to a medium to be printed and for depositing the printing material on the medium to perform printing, comprising:

control means for operating the printing head to perform preliminary ejection at least either one of upon the onset of power supply or prior to initiation of printing, the control means varying a drive frequency of the printing head during the preliminary ejection.

The printing head may have an electrothermal transducer generating heat energy for causing film boiling in the liquid state printing material, as an element generating energy to be used for ejecting the liquid state printing material.

The control means may initiate the preliminary ejection at a drive frequency lower than a head drive frequency in normal printing and gradually increases the head drive frequency.

The liquid ejection printing apparatus may further comprise a counter for counting a period of time while the liquid ejection printing apparatus is held resting and the control means may vary an initial head drive frequency depending upon the resting period.

The liquid ejection printing apparatus may further comprise a temperature detecting sensor for detecting environmental temperature and the control means may vary an initial head drive frequency upon initiation of the preliminary ejection depending upon the environmental temperature detected by the sensor.

The liquid election printing apparatus may further comprise a humidity detecting sensor for detecting a humidity in the environment and the control means may vary an initial head drive frequency upon initiation of the preliminary ejection depending upon the environmental humidity detected by the humidity detecting sensor.

The control means may increase the head drive frequency up to a final drive frequency in an arithmetical series manner per every given times of preliminary ejections.

The control means may increase the head drive frequency up to a final drive frequency in a geometrical series manner per every given times of preliminary ejections.

The resting period may be a period, in which the power source of the liquid ejection printing apparatus is held OFF.

The resting period may be a period, in which the printing head is maintained in stand-by state.

The liquid state printing material may be black ink.

The liquid state printing material may be color ink.

The liquid ejection printing apparatus may further comprise a carriage on which the printing head is mounted.

The liquid ejection printing apparatus may further comprise means for conveying the medium to be printed by the printing head.

The printing apparatus may be applied to a copying machine.

The printing apparatus may be applied to a facsimile apparatus.

The printing apparatus may be applied to an output terminal of a computer.

In a second aspect of the present invention, there is provided a method for liquid ejection printing by ejecting a liquid state printing material in the form of a droplet from a printing head to a medium to be printed and depositing the liquid state printing material on the medium, comprising the step of performing preliminary ejection at least either one of upon the onset of power supply or prior to initiation of printing with varying a drive frequency of the printing head.

The printing head may have an electrothermal transducer generating heat energy for causing film boiling in the liquid state printing material, as an element generating energy to be used for ejecting the liquid state printing material.

The method may comprise a step of controlling the head drive frequency in such a manner that the preliminary ejection is initiated at a frequency lower than a head drive frequency at normal printing and with gradually increasing the drive frequency of the printing head.

The method may comprise a step of varying an initial drive frequency of the printing head depending upon a period, in which liquid ejection of a liquid ejection printing apparatus is rested.

The method may comprise a step of varying an initial drive frequency of the printing head depending upon an environmental temperature.

The method may comprise a step of varying an initial drive frequency of the printing head depending upon an environmental humidity.

The head drive frequency may be increased up to a final drive frequency in an arithmetical series manner per every given times of preliminary ejections.

The head drive frequency may be increased up to a final drive frequency in a geometrical series manner per every given times of preliminary ejections.

The resting period may be a period, in which a power source of a liquid ejection printing apparatus is held OFF.

The resting period may be a period, in which the printing head of a liquid ejection printing apparatus is held in stand-by state.

With the present invention, upon preliminary ejection operation, by increasing an operation frequency depending upon lowering of viscosity of ink, the preliminary ejection is certainly done in a short period.

Since the preliminary ejection is performed with varying the head drive frequency from a low value to a high value, the preliminary ejection can be performed efficiently in a short period even for the liquid having high viscosity. Also, by optimally setting the head drive frequency upon initiation of the preliminary ejection depending upon a resting period, humidity and temperature, it becomes possible to perform the preliminary ejection adapting to the use condition and environmental condition.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENTS

Preferred embodiments of a liquid ejection printing apparatus according to the present invention will be discussed hereinafter with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to unnecessarily obscure the present invention.

Figure 9:
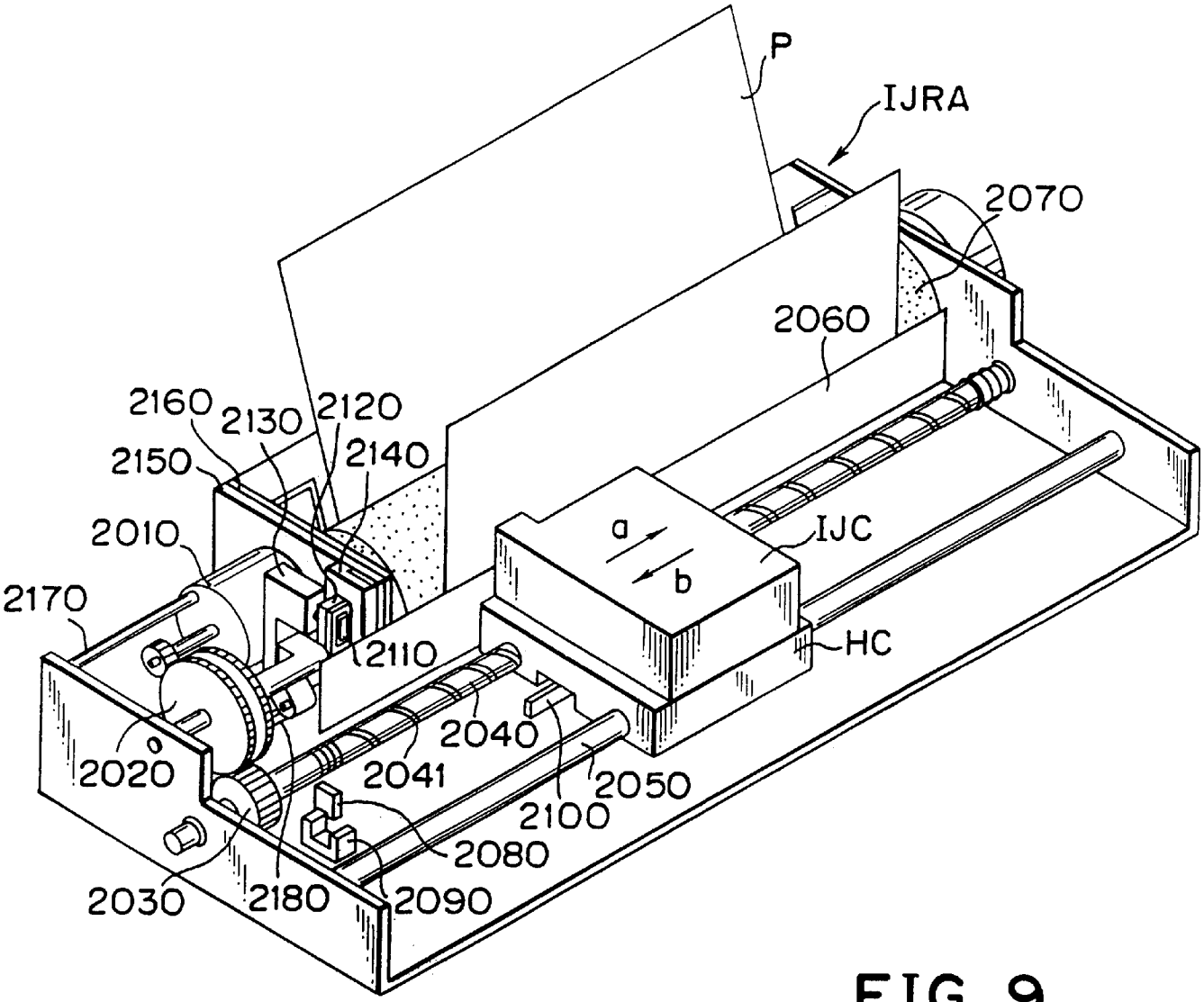
FIG. 9 is a perspective view showing one example of a printing apparatus to which the invention is applied.
Figure 10:
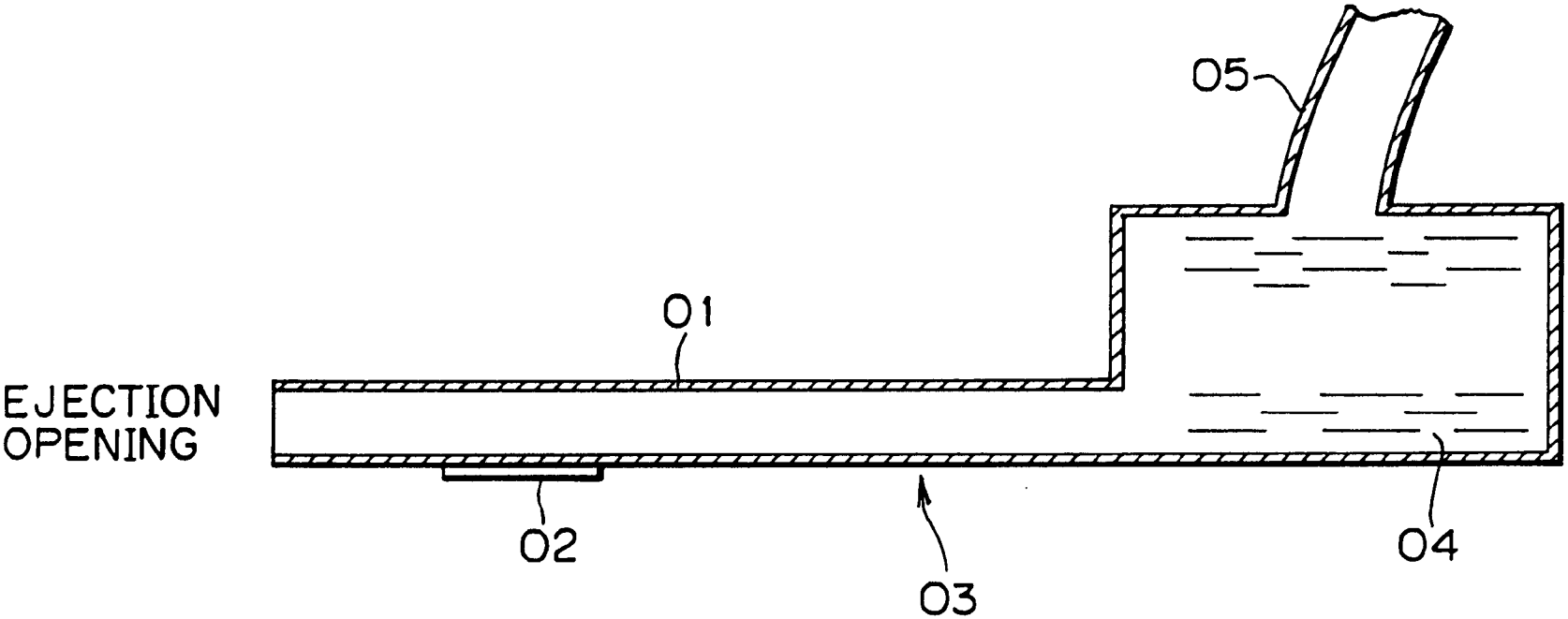
FIG. 10 is an illustration diagrammatically showing an experimental head.
Figure 11:
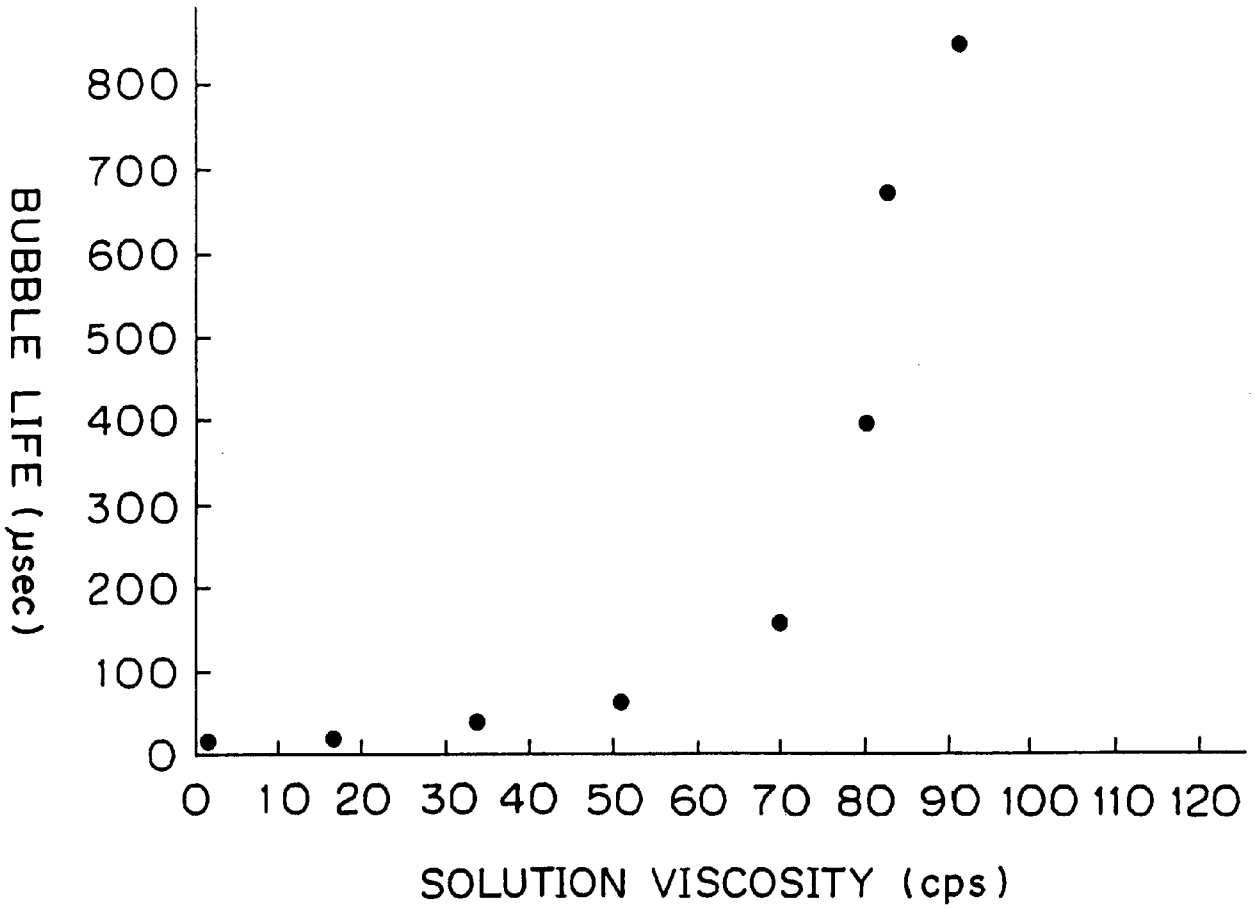
FIG. 11 an illustration showing a bubble life relative to the ink viscosity measured in the experimental head.

FIG. 9 is a general illustration showing one embodiment of an ink-jet printing apparatus, to which a control according to the present invention is applied. The shown ink-jet printing apparatus IJRA includes a lead screw 2040 to be rotatingly driven in forward and reverse directions according to forward and reverse revolutions of a drive motor 2010 via driving force transmission gears 2020 and 2030. A carriage HC carrying an ink-jet cartridge IJC is supported by a carriage shaft 2050 and the lead screw 2040 and has a pin (not shown) engaging with a spiral groove 2041 formed on the lead screw 2040. Therefore, the carriage HC with the ink-jet cartridge IJC is reciprocally driven along arrows a and b according to the rotation of the lead screw 2040. Reference numeral 2060 denotes a paper holding plate which extends in a carriage traveling direction to depress a sheet of paper P onto a platen roller 2070. 2080 and 2090 denote a photo coupler which serves as a home position detecting means for performing reversing of revolution direction of the motor 2010 and so forth by detecting presence of a lever 2100 provided on the carriage. 2110 denotes a capping member for capping the front surface of a printing head. The capping member 2110 is supported by a support member 2120. 2130 denotes a suction means for sucking the capping member to recover the printing head via an opening in the capping member. A cleaning blade for cleaning the end face of the printing head is provided on a member 2150 in longitudinally movable fashion. These are supported on a support plate 2160 of a main body. The configuration of the blade is not specified to the shown configuration. Needless to say, known cleaning blades are applicable for the shown embodiment. 2170 denotes a lever for initiation of suction in the sucking recovery, which lever 2170 is designed to be moved according to movement of a cam 2180 engaging with the carriage HC. By this, the driving force from the drive motor 2010 is controlled by a known transmission means, such as engaging and disengaging of a clutch and so forth for controlling motion.

In such ink-jet printing apparatus, in the ink-jet cartridge IJC, a drive circuit for controlling the ink-jet head and ejection of ink from nozzles of the head, is built-in. A control signal from CPU (not shown) is fed to the drive circuit and the drive motor 2010 and so forth. It should be noted that later mentioned preliminary ejection is performed toward an absorbing body (not shown), such as a sponge and so forth, when the carriage HC is positioned at the home position.

[First Embodiment]

Figure 1:
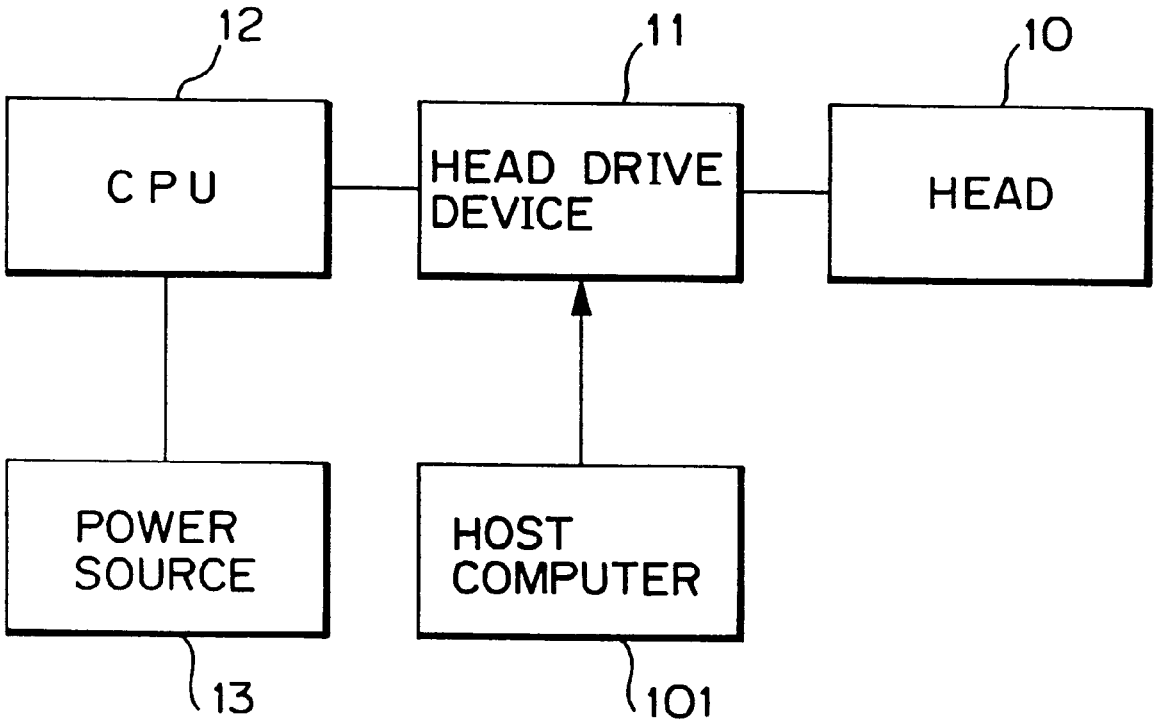
FIG. 1 is an illustration showing a control circuit for the first embodiment of a printing apparatus according to the present invention.
Figure 2:
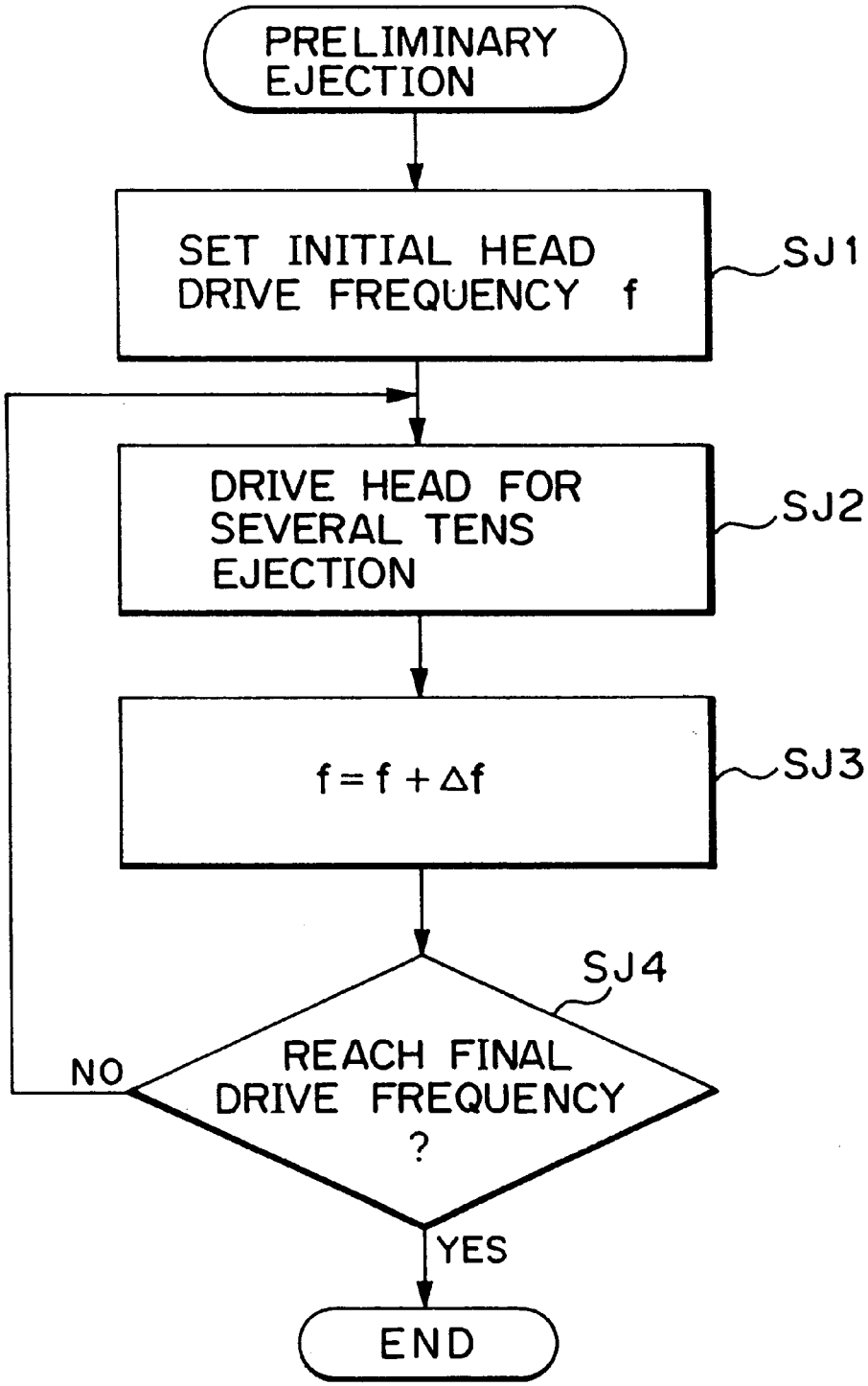
FIG. 2 is a flowchart for explaining an operation of preliminary ejection in the first embodiment.

FIGS. 1 and 2 illustrate the first embodiment according to the present invention.

FIG. 1 shows a control circuit of the printing apparatus. A printing head 10 is driven by a head drive device 11. The head drive device 11 is controlled by a central processing unit (CPU) 12. A power is supplied from a print power source 13 to the printing apparatus. An image signal is transmitted from an image signal source (host computer) 101 to the head drive device 11 so that printing is performed by the printing head 10.

FIG. 2 is a flowchart for explaining an operation of preliminary ejection.

Hereinafter, discussion will be given for preliminary ejection according to the flowchart of FIG. 2.

At first, at step SJ1, a printing head drive frequency f at initiation of preliminary ejection is set. The drive frequency f is set at a frequency lower than that in normal printing depending upon a kind of the printing head and printing method.

Next, at step SJ2, the printing head 10 is driven at the set drive frequency f to perform ejection of the liquid in the head 10 for several tens times.

Next, at step SJ3, the drive frequency is set at a frequency (f+Δf) higher than the initial drive frequency f to the extent of Δf.

Then, at step SJ4, judgement is made whether the drive frequency reaches a set final drive frequency. If the final drive frequency is not reached, the process returns to step SJ2 to drive the printing head 10 with the newly set drive frequency f to perform ejection of the liquid in the printing head 10 for several tens times.

Thus, steps SJ2 and SJ3 are repeated until the drive frequency reaches the predetermined final drive frequency set for the preliminary ejection. When the final drive frequency is reached, the process to perform preliminary ejection ends.

In a concrete example, the printing head which normally performs printing with the printing frequency of 5 kHz, is initially driven at the frequency of 500 Hz. The drive frequency is incremented by Δf=10 Hz, until the final frequency (f=2000 Hz) is reached. At each of the frequencies, preliminary ejection is performed for 50 times.

Namely, 50 times preliminary ejection is performed at the frequency of 500 Hz, initially. Then, another 50 times preliminary ejection is performed at the increased frequency of 510 Hz, a further 50 times preliminary ejection is performed at the increased frequency of 520 Hz, . . . , and at the final stage, 50 times preliminary ejection is performed at the frequency of 2000 Hz. Thus, as can be naturally understood, the drive frequency is increased from the lowest initial value to the predetermined final frequency.

As set forth above, in this embodiment, the viscosity of the liquid within the printing head is ejected at a low frequency, initially to eject out the high viscous liquid. When the preliminary ejection is progressed and the viscosity level of the liquid is lowered, the drive frequency is also increased according to lowering of the viscosity of the liquid.

It should be noted that, in a modification of the foregoing first embodiment, the manner of increasing the drive frequency f may be performed in a manner of geometrical series instead of arithmetical series. For instance, it is possible to perform the preliminary ejection in a manner that the initial ten times of ejection is performed at 2 Hz, next ten times of ejection is performed at 10 Hz, subsequent ten times of ejection is performed at a frequency of 50 Hz, yet subsequent ten times of ejection is performed at 250 Hz.

[Second Embodiment]

Figure 3:
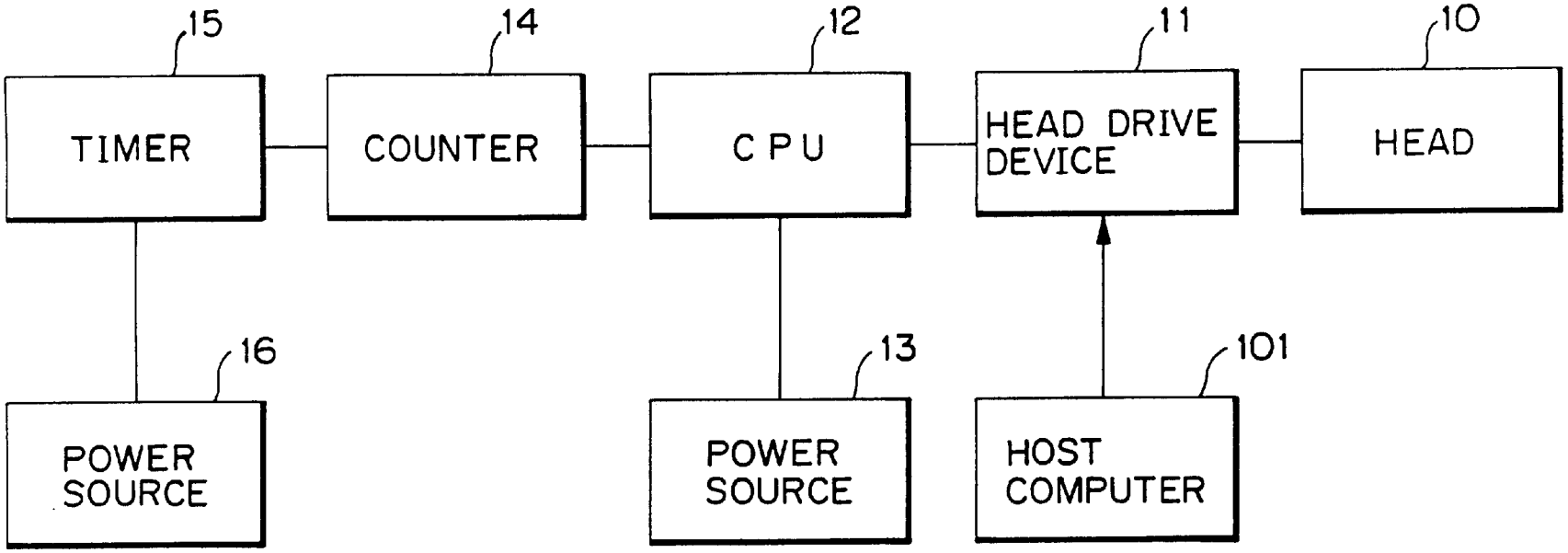
FIG. 3 is an illustration showing a control circuit in the second embodiment of a printing apparatus according to the invention.
Figure 4:
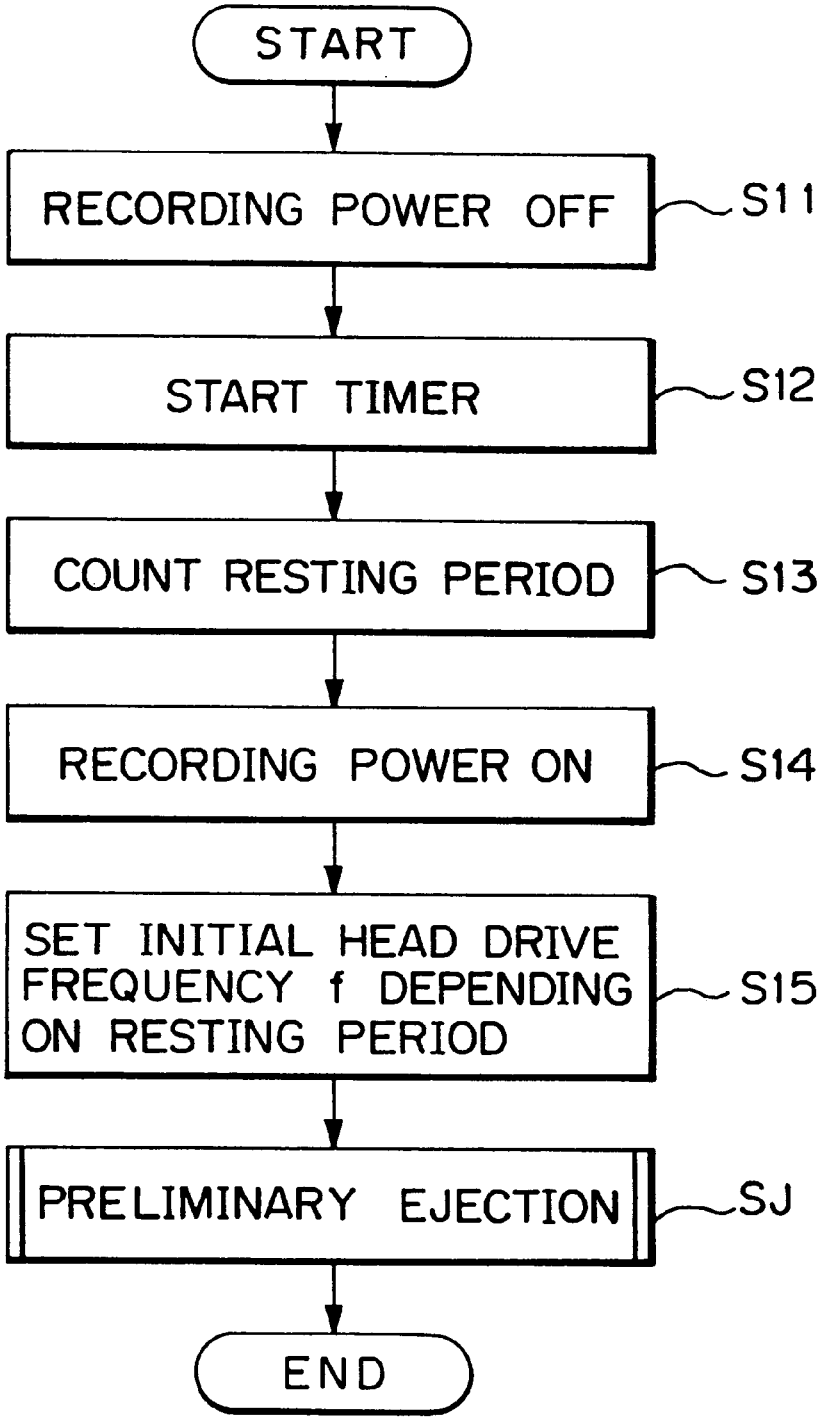
FIG. 4 is a flowchart for explaining the operation of preliminary ejection of the second embodiment.

FIGS. 3 and 4 show the second embodiment according to the present invention. The shown embodiment varies the initial value of the drive frequency for preliminary ejection depending upon a resting (non-use) period.

FIG. 3 shows a control circuit for the second embodiment of the printing apparatus. It should be noted that like reference numerals to the foregoing embodiment represent like elements. Therefore, detailed description for such common elements will be omitted for avoiding redundant discussion which may lead to confusion, and whereby to facilitate understanding. As shown in FIG. 3, a counter 14 is connected to CPU 12. To the counter 14, a timer 15 is connected. The timer 15 is electrically connected to a power source 16 which is different from the printing power source 13.

FIG. 4 is a flowchart showing an operation of preliminary ejection. Hereinafter, discussion will be given for preliminary ejection with reference to the flowchart of FIG. 4.

At step S11, the printing power source 13 is turned OFF, and at step S12, the timer is driven to initiate operation with the power source 16 other than the printing power source 13. At step S13, a period is counted up until the printing power source 13 is turned ON by the counter 14. Thus, when the printing power source 13 is turned ON at step S14, depending on the counter value of the counter 14, namely, the resting period, the initial head drive frequency f for initiation of preliminary ejection is set. Then, at step SJ, the preliminary ejection is performed while varying the drive frequency f from the low valve to the high value in a like manner set forth in the first embodiment.

Here, since the longer resting period should cause the larger amount of liquid to be evaporated at the ejection openings, the viscous resistance is increased due to increasing of viscosity of the liquid. Therefore, the drive frequency f to be set has to be a lower value.

For instance;

when the resting period is 0 min. f=2000 Hz;

when the resting period is 10 min. f=1000 Hz;

when the resting period is 20 min. f=600 Hz; and when the resting period is 30 min. f=300 Hz.

Thus, upon initiation of preliminary ejection, the initial head drive frequency is set.

The value may be set practically depending upon kind of the printing head and method of use.

On the other hand, while the resting period where the printing apparatus per se is placed in rest due to OFF state of the printing power supply is counted, it is also possible to count the non-printing state at the stand-by state of the printing head while the printing apparatus is maintained in ON state. Namely, it is possible to set the head drive frequency depending upon the resting period of the printing head.

[Third Embodiment]

Figure 5:
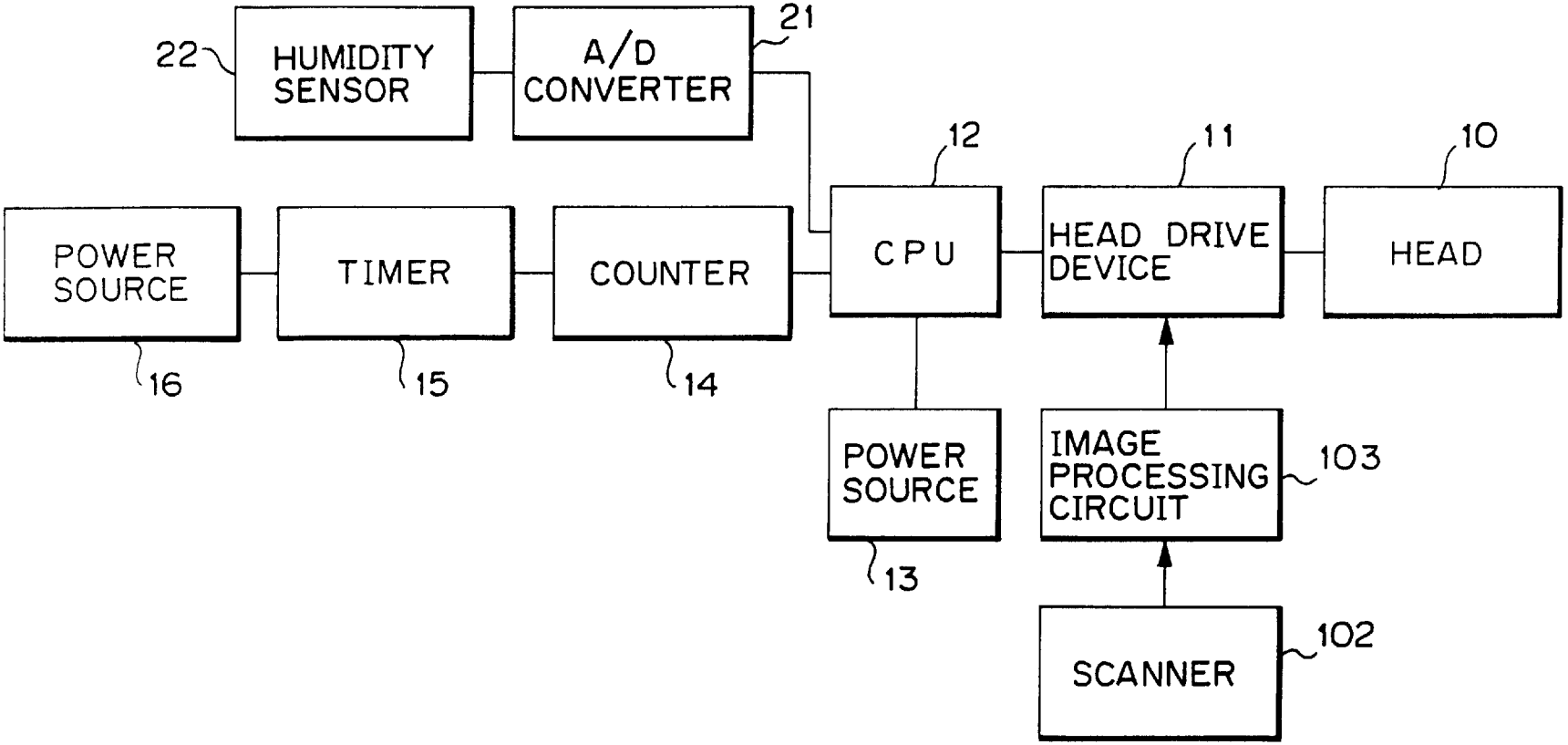
FIG. 5 is an illustration showing a control circuit in the third embodiment of a printing apparatus according to the invention.
Figure 6:
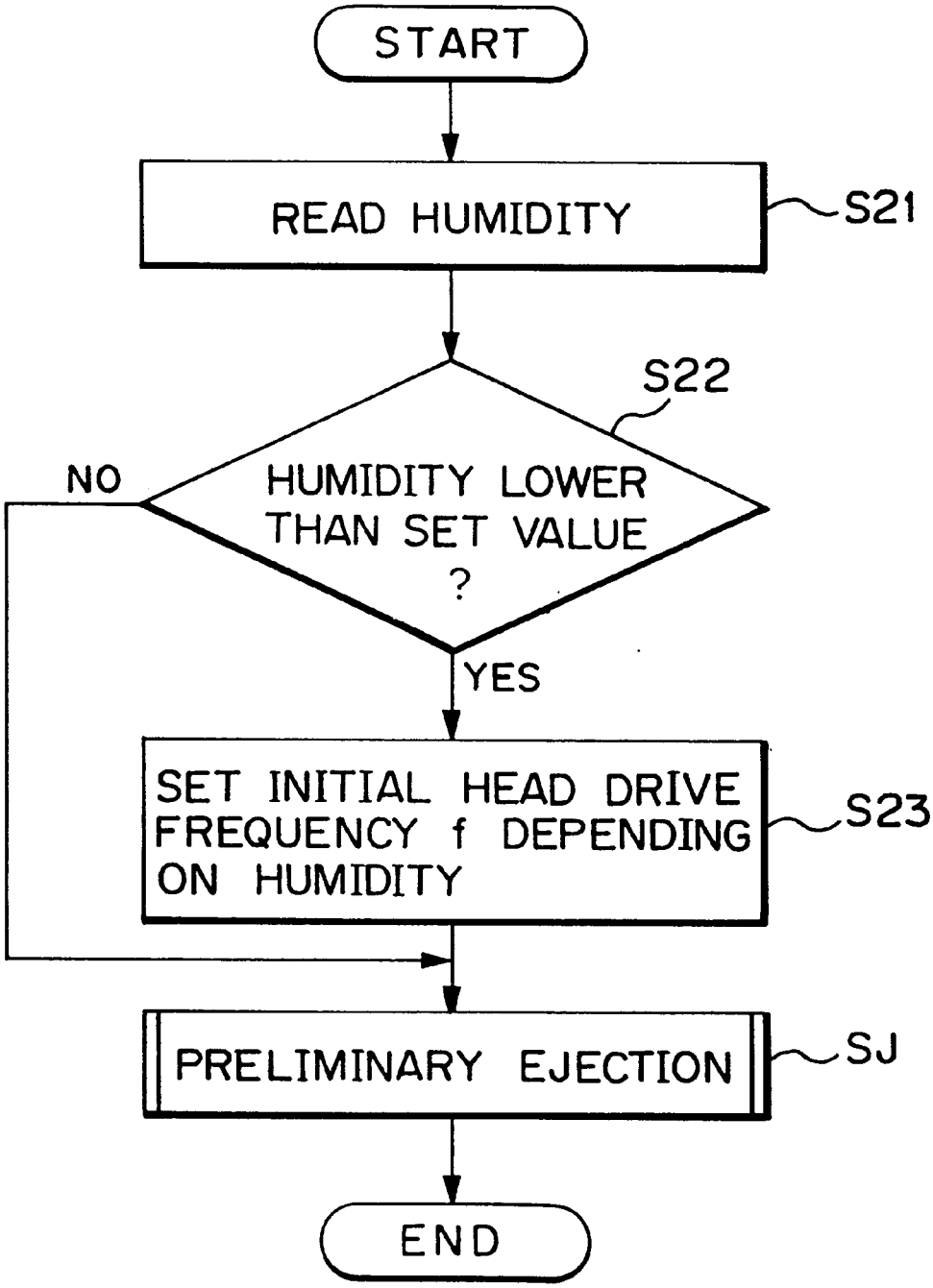
FIG. 6 is a flowchart for explaining an operation of preliminary ejection in the third embodiment.

FIGS. 5 and 6 illustrate the third embodiment according to the invention. The shown embodiment varies the initial drive frequency upon initiation of the preliminary ejection depending upon humidity.

The shown embodiment of the apparatus is a copying machine to read out an original by means of a scanner 102 and to print the read out image information. The apparatus has an ink-jet head for ejecting liquid droplets through a plurality of nozzles.

FIG. 5 shows a control circuit for the printing apparatus. In the drawings, like reference numerals to those in the foregoing FIG. 3 represent like elements, and detailed discussion therefor is omitted. As shown, the scanner 102 is connected to the head drive device 11 via an image processing circuit 103. The image processing circuit 103 performs image processing on the basis of the image information read out by the scanner 102 so that the printing head 10 may print the image. In concrete, the image processing portion determines the timing and active nozzles relative to scanning. Also, to CPU 12, a humidity sensor 22 is connected via an analog-to-digital (A/D) converter 21.

FIG. 6 is a flowchart showing an operation of the preliminary ejection. Hereinafter, an operation of the preliminary ejection will be discussed according to the flowchart of FIG. 6. It should be noted that, while the shown embodiment measures the resting period of the copying machine by means of the counter 14 and the timer 15 and sets the head drive frequency f upon initiation of the preliminary ejection in substantially the same manner as the foregoing second embodiment, discussion for such process is omitted for avoiding redundant discussion.

In the shown embodiment, at step S21, when the printing power source 13 is turned ON, a humidity data measured by the humidity sensor 22 is input to CPU 12 via the A/D converter 21. Next, at step S22, judgement is made whether the humidity is lower than a set value or not. When the humidity is higher than the set value so that evaporation of liquid is not progressed significantly, the head drive frequency f upon initiation of the preliminary ejection is set depending upon the resting period of the printing apparatus, similarly to the foregoing second embodiment. On the other hand, when the humidity is lower than the preliminarily set value and thus the evaporation speed of the liquid is significant, the head drive frequency at initiation of the preliminary ejection is set to be further lower frequency at step S23. Then, at step SJ, the preliminary ejection is performed while varying the drive frequency from the lower value to the higher value similarly to the foregoing first embodiment.

Here, the control set forth above is based on the fact that a lower humidity promotes a higher rate of evaporation of the liquid at the ejection openings so as to increase viscous resistance due to increasing of the viscosity of the liquid, requiring the head drive frequency to be set at further lower value. Accordingly, the data read from the humidity sensor 22 is preferably an average value during resting period of the printer. However, the data upon onset of the power supply may also be used.

[Fourth Embodiment]

Figure 7:
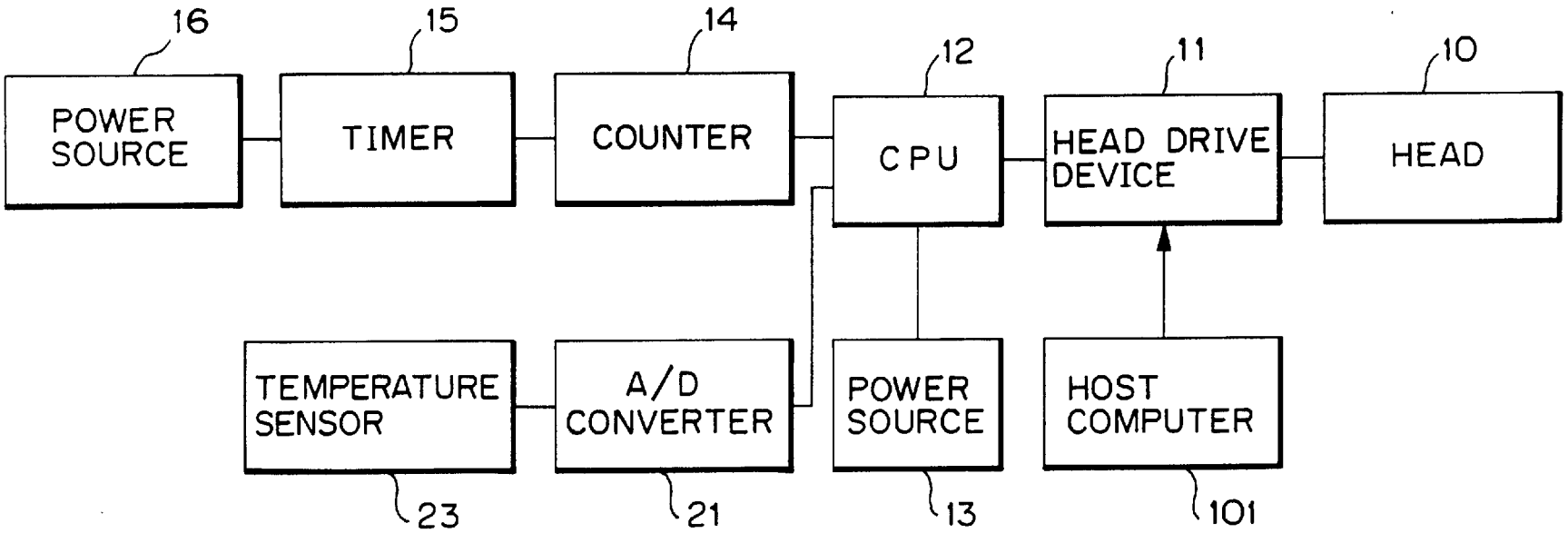
FIG. 7 is an illustration showing a control circuit of the fourth embodiment of a printing apparatus according to the invention.
Figure 8:
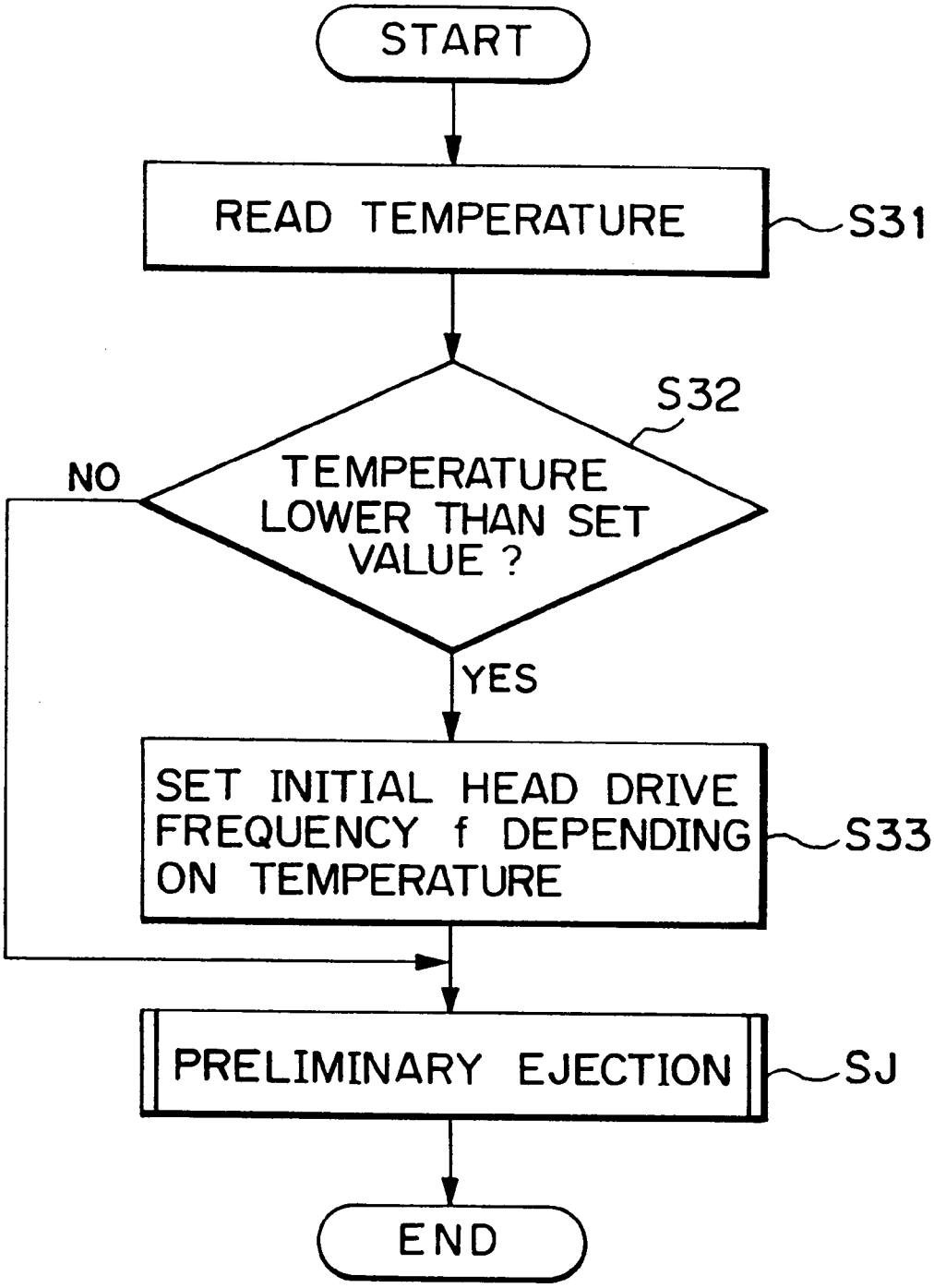
FIG. 8 is a flowchart for explaining an operation of in preliminary ejection to be performed by the fourth embodiment.

FIGS. 7 and 8 illustrate the fourth embodiment according to the present invention. In this embodiment, the initial value of the drive frequency is variable depending upon a temperature.

FIG. 7 shows a control circuit of the printing apparatus. In the drawings, the like reference numerals those in the foregoing FIG. 3 represent like elements, and discussion therefor will be omitted. The shown embodiment of the printing apparatus is basically the same as that of the foregoing second embodiment. However, a temperature sensor 23 is connected to CPU 12 via an A/D converter 21.

FIG. 8 is a flowchart showing an operation for the preliminary ejection. It should be noted that while the shown embodiment measures the resting period of the copying machine by means of the counter 14 and the timer 15 and sets the head drive frequency f upon initiation of the preliminary ejection in substantially the same manner as the foregoing second embodiment, discussion for such process is omitted for avoiding redundant discussion.

In the shown embodiment, upon onset of printing power source 13, a temperature data measured by the temperature sensor 23 is read in the CPU 12 via the A/D converter 21, at step S31. Then, at step S32, judgement is made whether the temperature is lower than a preliminary set value or not. When the temperature is higher than the set value and thus the viscosity of the liquid is not so high, the head drive frequency f upon initiation of the preliminary printing is set depending upon the resting period of the printing apparatus, similarly to the foregoing second embodiment. On the other hand, when the temperature is lower than the set value, the head drive frequency f upon initiation of the preliminary ejection is set to be further lower, at step S33. Then, at step SJ, the preliminary ejection is performed while varying the drive frequency from the lower value to the higher value similarly to the foregoing first embodiment.

Here, the control set forth above is based on the fact that a lower temperature should cause increasing viscous resistance due to increasing of the viscosity of the liquid, requiring the head drive frequency to be set at further lower value. Accordingly, the data read from the temperature sensor 23 is preferably an average value during resting period of the printer. However, the data upon onset of the power supply may also be used.

Further, it may be possible to combine the third and the fourth embodiments so as to set the initial drive frequency f based on temperature and humidity.

The present invention achieves distinct effects when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof are disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consist of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A liquid ejection printing apparatus for printing on a medium by ejecting a droplet of a liquid printing material through a printing head to the medium to be printed and depositing the printing material on the medium, comprising:

control means for controlling said printing head to perform preliminary ejection prior to initiation of printing, said control means varying a drive frequency of said printing head during the preliminary ejection, wherein said control means initiates the preliminary ejection at an initial predetermined frequency lower than a head drive frequency in normal printing and increases said head drive frequency during the preliminary ejection.

2. A liquid ejection printing apparatus as claimed in claim 1, wherein said printing head comprises an electrothermal transducer generating heat energy for causing film boiling in said liquid printing material to eject said liquid printing material.

3. A liquid ejection printing apparatus as claimed in claim 1, further comprising a counter for counting time of a resting period, the resting period being a period in which said liquid ejection printing apparatus is held resting, wherein said control means varies the initial predetermined frequency upon initiation of the preliminary ejection depending upon the resting period.

4. A liquid ejection printing apparatus as claimed in claim 3, wherein said resting period is a period, in which power from a power source is not supplied to said liquid ejection printing apparatus.

5. A liquid ejection printing apparatus as claimed in claim 3, wherein said resting period is a period, in which said printing head is maintained in a stand-by state.

6. A liquid ejection printing apparatus as claimed in claim 1, further comprising a temperature detecting sensor for detecting environmental temperature, wherein said control means varies an initial head drive frequency upon initiation of the preliminary ejection depending upon the environmental temperature detected by said sensor.

7. A liquid ejection printing apparatus as claimed in claim 1, further comprising a humidity detecting sensor for detecting environmental humidity, wherein said control means varies an initial head drive frequency upon initiation of the preliminary ejection depending upon the environmental humidity detected by said humidity detecting sensor.

8. A liquid ejection printing apparatus as claimed in claim 1, wherein said control means increases said head drive frequency by a predetermined amount up to a final drive frequency per every predetermined number of preliminary ejections.

9. A liquid ejection printing apparatus as claimed in claim 1, wherein said control means increases said head drive frequency by increasing amounts up to a final drive frequency per every predetermined number of preliminary ejections.

10. A liquid ejection printing apparatus as claimed in claim 1, wherein said liquid printing material comprises black ink.

11. A liquid ejection printing apparatus as claimed in claim 1, wherein said liquid printing material comprises color ink.

12. A liquid ejection printing apparatus as claimed in claim 1, further comprising a carriage on which said printing head is mounted.

13. A liquid ejection printing apparatus as claimed in claim 1, further comprising means for conveying said medium to be printed by said printing head.

14. A liquid ejection printing apparatus as claimed in claim 1, wherein said printing apparatus is utilized in a copying machine.

15. A liquid ejection printing apparatus as claimed in claim 1, wherein said printing apparatus is utilized in a facsimile apparatus.

16. A liquid ejection printing apparatus as claimed in claim 1, wherein said printing apparatus is utilized an output terminal of a computer.

17. A liquid ejection printing apparatus as claimed in claim 1, wherein said control means controls said printing head to perform preliminary ejection upon onset of power supply.

18. A method for liquid ejection printing by ejecting a liquid printing material as a droplet from a printing head to a medium to be printed and depositing the liquid printing material on the medium, said method comprising the steps of:

performing preliminary ejection prior to initiation of printing; and controlling the head drive frequency such that the preliminary ejection is initiated at an initial predetermined frequency lower than a head drive frequency at normal printing and increasing the head drive frequency of said printing head during the preliminary ejection.

19. A method for liquid ejection printing as claimed in claim 18, wherein said printing head comprises an electrothermal transducer generating heat energy for causing film boiling in said liquid printing material to eject said liquid printing material.

20. A method for liquid ejection printing as claimed in claim 18, wherein said controlling step comprises a step of varying the initial predetermined frequency of said printing head depending upon a resting period, the resting period being a period in which liquid ejection of a liquid ejection printing apparatus is not effected.

21. A method for liquid ejection printing as claimed in claim 20, wherein said resting period is a period in which power from a power source is not supplied to said liquid ejection printing apparatus.

22. A method for liquid ejection printing as claimed in claim 20, wherein said resting period is a period, in which said printing head of said liquid ejection printing apparatus is held in a stand-by state.

23. A method for liquid ejection printing as claimed in claim 18, wherein said method comprises a step of varying an initial drive frequency of said printing head depending upon an environmental temperature.

24. A method for liquid ejection printing as claimed in claim 18, wherein said method comprises a step of varying an initial drive frequency of said printing head depending upon an environmental humidity.

25. A method for liquid ejection printing as claimed in claim 18, wherein said head drive frequency is increased by a predetermined amount up to a final drive frequency per every predetermined number of preliminary ejections.

26. A method for liquid ejection printing as claimed in claim 18, wherein said head drive frequency is increased by increasing amounts up to a final drive frequency per every predetermined number of preliminary ejections.

27. A method for liquid ejection printing as claimed in claim 18, wherein said preliminary ejection performing step is performed upon onset of power supply.

* * * * *

UNITED STATES PATENT AND TRADEMARK OFFICE

CERTIFICATE OF CORRECTION

PATENT NO. : 6,033,050

DATED : March 7, 2000

INVENTOR(S) : MORITA ET AL.

It is certified that error appears in the above-identified patent and that said Letters Patent is hereby corrected as shown below:

[56] References Cited:

FOREIGN PATENT DOCUMENTS,

"442438 8/1991 European Pat. Off." (second occurrence) should be deleted.

"2202453" should read --2-202453--.

[57] ABSTRACT:

Line 1, "quickly" should read --can quickly--.

COLUMN 1:

Line 16, "a" should be deleted.

Line 62, "heat to" should read --head--.

COLUMN 2:

Line 2, "set" should read --set at--.

Line 24, "compared" should read --as compared--.

Line 30, "μm ," should read --μm,--.

COLUMN 3:

Line 53, "election" should read --ejection--.

COLUMN 4:

Line 22, "of" should read --of:--.

UNITED STATES PATENT AND TRADEMARK OFFICE

CERTIFICATE OF CORRECTION

PATENT NO. : 6,033,050

DATED : March 7, 2000

INVENTOR(S) : MORITA ET AL.

It is certified that error appears in the above-identified patent and that said Letters Patent is hereby corrected as shown below:

COLUMN 5:
Line 34, "in" should be deleted.
Line 54, "instance," should read --instances,--.
Line 55, "in order to" should read --in order not to--.

COLUMN 7:
Line 43, "for avoiding" should read --to avoid--.
Line 63, "valve" should read --value--.

COLUMN 8:
Line 10, "kind" should read --the kind--.
Line 11, "the" should be deleted.
Line 48, "for" (first occurrence) should read --of--.
Line 63, "further" should read --at a further--.

COLUMN 9:
Line 5, "further" should read --a further--.
Line 16, "those" should read --to those--.
Line 49, "further" should read --a further--.

UNITED STATES PATENT AND TRADEMARK OFFICE

CERTIFICATE OF CORRECTION

PATENT NO. : 6,033,050

DATED : March 7, 2000

INVENTOR(S) : MORITA ET AL.

It is certified that error appears in the above-identified patent and that said Letters Patent is hereby corrected as shown below:

COLUMN 10:

Line 25, "to" should read --into--.

Signed and Sealed this

Third Day of April, 2001

*Attest:*

Nicholas P. Godici

NICHOLAS P. GODICI

*Attesting Officer*

*Acting Director of the United States Patent and Trademark Office*